US005654665A

United States Patent [19]

Menon et al.

[11] Patent Number: 5,654,665

[45] Date of Patent: Aug. 5, 1997

[54] PROGRAMMABLE LOGIC BIAS DRIVER

[75] Inventors: Suresh M. Menon, Sunnyvale; Tsung Chuan Whang, Cupertino, both of Calif.

[73] Assignee: Dynachip Corporation, Sunnyvale, Calif.

[21] Appl. No.: 444,111

[22] Filed: May 18, 1995

[51] Int. Cl.[6] ..... G05F 3/02

[52] U.S. Cl. ..... 327/541; 327/540; 327/543; 327/546; 323/313; 323/315

[58] Field of Search ..... 327/538, 540, 327/541, 543, 545, 546, 539; 323/312, 313, 315

[56] References Cited

U.S. PATENT DOCUMENTS

| | | | |
|---|---|---|---|
| 4,251,743 | 2/1981 | Hareyama | 327/538 |
| 4,325,018 | 4/1982 | Schade, Jr. | 323/313 |
| 4,763,021 | 8/1988 | Stickel | 327/541 |
| 4,849,684 | 7/1989 | Sonntag et al. | 323/313 |
| 4,897,596 | 1/1990 | Hughes | 323/315 |
| 4,912,347 | 3/1990 | Morris | 327/541 |
| 5,087,830 | 2/1992 | Cave et al. | 323/314 |
| 5,109,187 | 4/1992 | Guliani | 323/313 |
| 5,235,222 | 8/1993 | Kondoh et al. | 327/541 |
| 5,245,273 | 9/1993 | Greaves et al. | 323/313 |
| 5,434,534 | 7/1995 | Lucas | 327/541 |

*Primary Examiner*—Terry Cunningham

*Attorney, Agent, or Firm*—Townsend and Townsend and Crew LLP

[57] ABSTRACT

A biasing system for a differential amplifier includes an NMOS current source and a gate bias voltage generator. The gate bias voltage generator produces a bias voltage VNCS to control the NMOS current source. The gate bias generator includes a reference current generator to produce a reference current relatively independent of supply voltage variations. A temperature compensator regulates the reference current to provide a temperature compensated current. A current mirror duplicates the temperature compensated current to a bias voltage generator. The bias voltage generator generates the bias voltage.

3 Claims, 3 Drawing Sheets

PROGRAMMABLE LOGIC BIAS DRIVER

CROSS-REFERENCE TO RELATED APPLICATIONS

The following applications, assigned to the present Assignee, HIGH SPEED PROGRAMMABLE LOGIC ARCHITECTURE, Ser. No. 08/188,499, Filed Jan. 27, 1994, and BiCMOS REPEATER CIRCUIT FOR A PROGRAMMABLE LOGIC DEVICE, Ser. No. 08/352,402, Filed Dec. 8, 1994, are hereby expressly incorporated by reference for all purposes.

BACKGROUND OF THE INVENTION

This invention relates to programmable logic, and in particular to a simple bias driver for a current source that has no feedback and provides good supply rejection.

As described in the incorporated patent applications, programmable logic devices include thousands of repeaters, buffers and logic blocks distributed across a fairly large semiconductor structure. Many of the elements making up various programmable logic circuits described in the co-pending patent applications use bipolar differential amplifiers.

FIG. 1 is a schematic diagram of one example of a conventional differential amplifier 10. Differential amplifier 10 is a common configuration designed to amplify a difference voltage between two input signals. Differential amplifier 10 includes two NPN transistors ($T_1$ and $T_2$), two collector resistors ($R_{C1}$ and $R_{C2}$) coupling collectors of the transistors to a first reference voltage, and a current source 12 coupling emitters of the transistors to a second reference voltage. The input signals are provided to the bases of transistors $T_1$ and $T_2$. An output taken at the collector of transistor $T_2$ provides a voltage that depends upon the difference of the input signal voltages.

The prior art recognized that the use of current source 12 as a bias current provides differential amplifier 10 with a common-mode gain that is about zero. There are many types of possible current sources that could be used with differential amplifier 10.

FIG. 2 is a schematic diagram of one typical type of current source 12. Current source 12 includes an NPN transistor $T_3$ and an emitter resistor $R_E$. Resistor $R_E$ couples the emitter of transistor $T_3$ to the second reference voltage. To control current source 12, a bias circuit must provide both a base bias current and a base bias voltage.

There are a number of drawbacks when using current source 12, or similar types of current sources. These drawbacks relate to bias signal distribution, size, and operation. The large size of typical programmable logic devices and the use of differential amplifiers across the entire semiconductor structure requires distribution of the bias current and the bias voltage. There are many well-known problems with distribution of bias signals, not the least of which is compensation of capacitive loading of long lead lines that interconnect the bias circuit and the current sources used with each of the thousands of differential amplifiers.

With respect to the size drawback, current source 12 includes transistor $T_3$ and resistor $R_E$. Together these elements require a relatively large amount of space on the semiconductor structure. When the number of current sources is large, the space required for each current source becomes significant.

Regarding the operational drawback, under particular conditions, transistor $T_3$ can go into saturation. For a circuit integrated on a single semiconductor structure, it is undesirable for a bipolar transistor to operate in its saturation region as charge gets dumped into a substrate of the semiconductor structure. It is undesirable to dump charge into the substrate. The likelihood of a transistor going into saturation is increased when turning the transistor on and off. Programmable logic devices include the ability to turn various differential amplifiers on and off, typically by turning its associated current source on and off.

SUMMARY OF THE INVENTION

The present invention provides an improved current source for differential amplifiers used in logic elements of a programmable logic device, as well as an improved master bias system for control of the improved current source.

According to one aspect of the invention, a current source for a differential amplifier includes a single NMOS transistor. The NMOS transistor includes a source, a drain and a gate. The NMOS transistor current source requires only a gate bias voltage to control operation. Distribution difficulties of the gate bias voltage are minimized because the gate has a very large input impedance, meaning that virtually no gate bias current is required. Thus, effects from capacitive loading of distribution lines is minimized. The other drawbacks of the bipolar current source are reduced or eliminated. The NMOS transistor takes up less space than the bipolar transistor and resistor combination, and the NMOS transistor will not go into saturation and dump charge into the substrate.

According to another embodiment of the present invention, an improved and simplified bias voltage generator is disclosed that provides for temperature regulation and supply rejection without use of feedback. The improved bias voltage generator includes a circuit for biasing a plurality of differential amplifiers distributed across a semiconductor device having a programmable logic array. The circuit includes a plurality of NMOS transistor current sources coupled to each of the plurality of differential amplifiers, each NMOS transistor current source coupled to a particular one differential amplifier and having a gate terminal for receiving a bias voltage for controlling a bias current in the particular one differential amplifier. A bias voltage generator, coupled to each of the plurality of NMOS transistor current sources, generates the bias voltage in response to a regulated current. A current generator generates a reference current. A temperature compensator, coupled to the current generator, produces a regulated current from the reference current. A current mirror, coupled to the temperature compensator and to the bias voltage generator, mirrors the regulated current produced in the temperature compensator to the bias voltage generator.

Reference to the remaining portions of the specification, including the drawing and claims, will realize other features and advantages of the present invention. Further features and advantages of the present invention, as well as the structure and operation of various embodiments of the present invention, are described in detail below with respect to accompanying drawing. In the drawing, like reference numbers indicate identical or functionally similar elements.

DESCRIPTION OF THE PREFERRED EMBODIMENT

Figure 1:
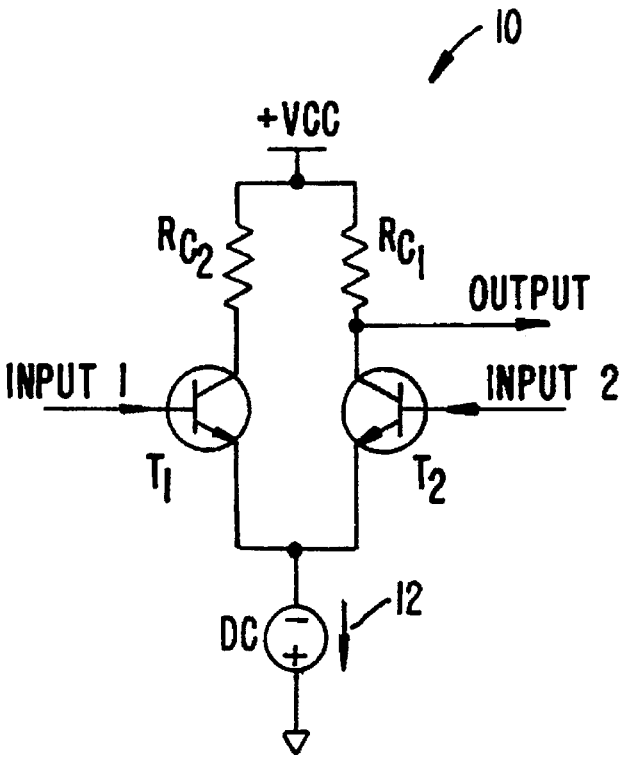
FIG. 1. (PRIOR ART)
FIG. 1 is a schematic diagram of a conventional differential amplifier that uses a current source.
Figure 2:
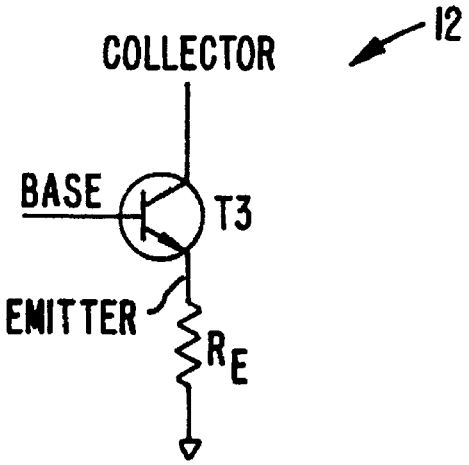
FIG. 2. (PRIOR ART)
FIG. 2 is a schematic diagram of a conventional current source.
Figure 3:
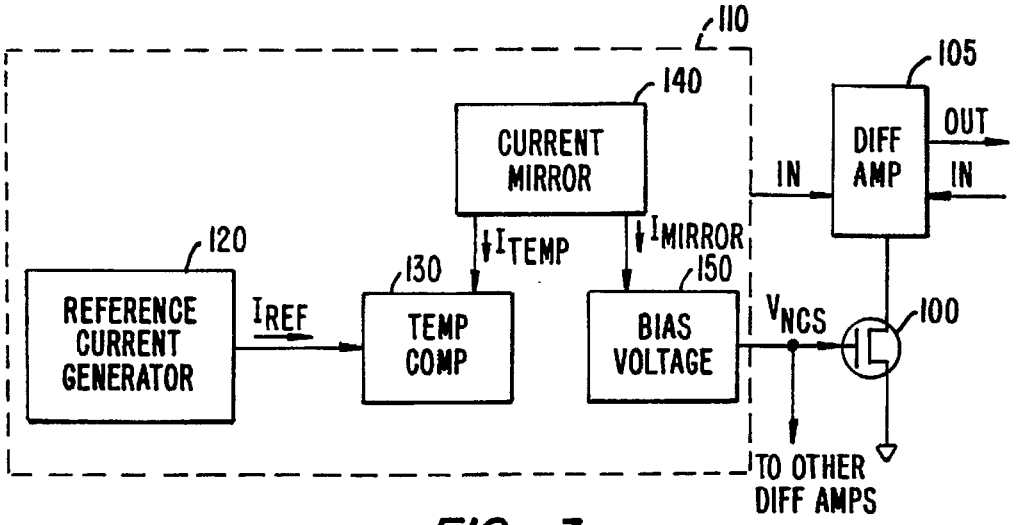
FIG. 3 is a block diagram of a preferred embodiment of the present invention including an NMOS current source for a differential amplifier and a bias circuit for the NMOS current source.

FIG. 3 is a block diagram of a preferred embodiment of the present invention including an NMOS current source 100 for a differential amplifier 105 and a bias circuit 110 for NMOS current source 100. NMOS current source 100 includes an NMOS transistor having a source coupled to a ground potential and a drain coupled to differential amplifier 105. Differential amplifier 105 may be configured as shown by transistors $T_1$ and $T_2$ and resistors $R_{C1}$ and $R_{C2}$ in FIG. 1, or may include other configurations, some of which are well known in the prior art. A gate bias voltage ($V_{NCS}$) applied to a gate of the NMOS transistor controls a bias current of differential amplifier 105. Bias circuit 110 generates the gate bias voltage to control NMOS current source 100.

Bias circuit 110 includes a reference current generator 120, a temperature compensator 130, a current mirror 140, and a bias voltage generator 150 to generate the gate bias voltage. Reference current generator produces a reference current $I_{REF}$ from a reference voltage (e.g., $+V_{cc}$). The preferred embodiment of the present invention operates using voltage levels for $V_{cc}$ appropriate for emitter-coupled logic (ECL). Here, $V_{cc}$ is 4.50 volts ±7%. It is important that the reference current $I_{REF}$ not vary due to variations in $V_{cc}$. Reference current generator 120 is designed to provide reference current $I_{REF}$ having little variation due to changes in $V_{cc}$.

Additionally, process variations in resistor components of differential amplifier 105 will affect the differential gain it experiences. Reference current generator 120 is designed to adjust the reference current $I_{REF}$ to adjust for resistor variations. Details regarding the supply rejection and process variation adjustment are provided below.

Temperature compensator 130 is responsive to the reference current to produce a temperature-compensated current ($I_{TEMP}$). It is well-known that temperature changes will affect operation of semiconductor elements, such as those used in the preferred embodiment. In semiconductor devices, especially those integrated together on a single monolithic semiconductor structure, it is possible to wholly or partially compensate for temperature variations. Temperature compensator 130 regulates $I_{TEMP}$ to compensate for temperature variations. In the preferred embodiment, temperature compensator 130 includes two parts: a first part that adjusts $I_{TEMP}$ inversely as temperature changes, and a second part that varies $I_{TEMP}$ directly as temperature changes. The contributions of these two parts are dependent upon the overall design requirements. It is possible to balance the two parts so that $I_{TEMP}$ has minimal or zero change due to temperature variations. For other embodiments, the contribution of one of the parts will be greater than the other part to provide a net change to $I_{TEMP}$ in response to temperature variations. The change in $I_{TEMP}$ can be directly or inversely related to temperature changes, depending upon which part has the larger contribution.

Current mirror 140 responds to $I_{TEMP}$ to establish a mirrored current $I_{MIRROR}$ where $I_{MIRROR}$ equals $I_{TEMP}$ * CONSTANT. In the preferred embodiment, the constant is about equal to one, so $I_{MIRROR}$ equals $I_{TEMP}$ . Depending upon particular designs, $I_{MIRROR}$ may be made larger or smaller than $I_{TEMP}$.

Bias voltage generator 150 responds to $I_{MIRROR}$ to generate the gate bias voltage for NMOS current source 100. Thus, the gate bias voltage 150 is a derived from a regulated and process-variation-adjusted reference current. The magnitude of the gate bias voltage affects the current in NMOS current source 100, compensating for temperature or process variations. The gate bias voltage varies little with variations in supply voltage, and there is no feedback from current source 100 or differential amplifier 102 to control the magnitude of the gate bias voltage.

Figure 4:
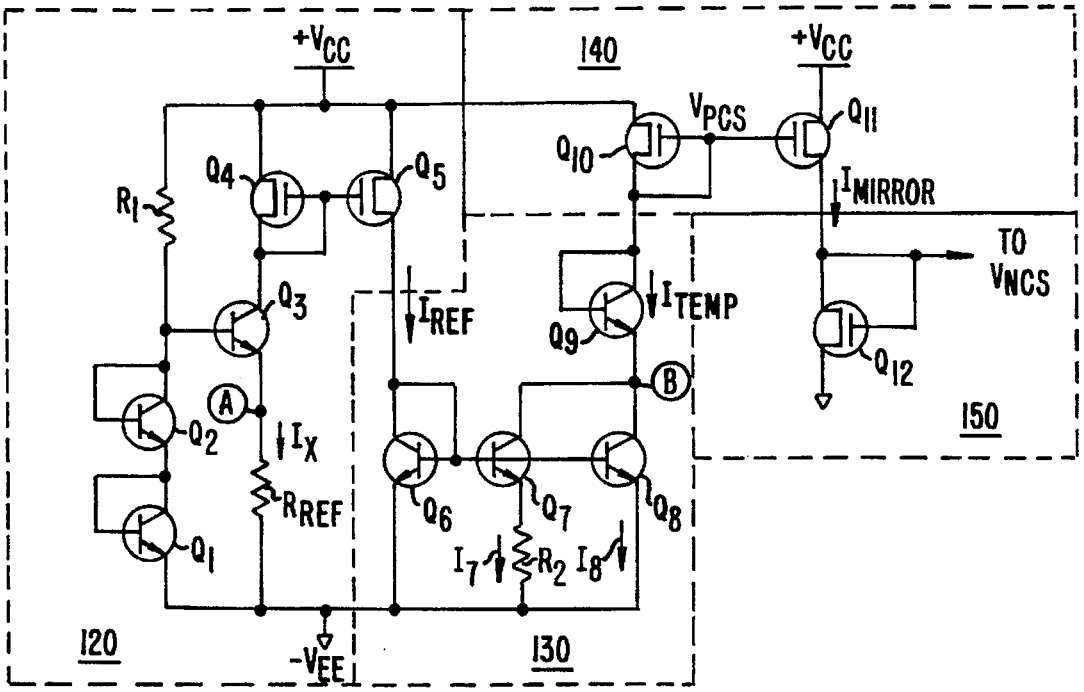
FIG. 4 is detailed schematic diagram of the bias circuit for the NMOS current source.

FIG. 4 is detailed schematic diagram of the bias circuit 110 for generation of the gate bias voltage for NMOS current source 100 shown in FIG. 3. Reference current generator 120 includes three NPN bipolar transistors ($Q_1$, $Q_2$, and $Q_3$), two resistors ($R_1$ and $R_{REF}$), and a PMOS current mirror including two PMOS transistors ($Q_4$ and $Q_5$).

A first terminal of resistor $R_1$ is coupled to a first voltage reference $V_{cc}$. Transistor $Q_1$ and transistor $Q_2$ each have a collector, an emitter and a base with the base coupled to the collector. The emitter of transistor $Q_1$ is coupled to a second voltage reference $V_{EE}$. The emitter of transistor $Q_2$ is coupled to the collector of transistor $Q_1$. The collector of transistor $Q_2$ is coupled to a second terminal of resistor $R_1$. In the preferred embodiment, first reference voltage $V_{cc}$ is about 4.50 volts, and second reference voltage $V_{EE}$ is about 0.00 volts.

A first terminal of resistor $R_{REF}$ is coupled to the second voltage reference $V_{EE}$. An emitter of transistor $Q_3$ is coupled to a second terminal of resistor $R_{REF}$. A base of transistor $Q_3$ is coupled to the collector of transistor $Q_2$.

PMOS transistor $Q_4$ and PMOS transistor $Q_5$ each include a gate, a source and a drain. The sources of transistor $Q_4$ and transistor $Q_5$ are coupled to the first reference voltage. The gate of transistor $Q_4$ is coupled to the gate of transistor $Q_5$, with the drain of transistor $Q_4$ coupled to the collector of transistor $Q_3$.

In operation, the voltage level present at the base of transistor $Q_3$ is about equal to two $V_{be}$ (voltage drop from base to emitter in a bipolar transistor), as established by the stack of the two diode-connected transistors $Q_1$ and $Q_2$ There is a voltage drop of one $V_{be}$ between the base of transistor $Q_3$ to the emitter of transistor $Q_3$. Therefore, at node A, the voltage potential is about one $V_{be}$ above the voltage level of second voltage reference $V_{EE}$. Thus, resistor $R_{REF}$ establishes a current $I_x$ that is about equal to $V_{be}$ divided by the resistance of $R_{REF}$. This configuration of the reference current generator results in small variations in current $I_x$ due to changes in the power supply voltage. As described, $I_x$ varies as the value of $V_{be}$ changes. In the preferred embodiment, $V_{be}$ varies by about 60 mV per decade change in current at 27° C. Over temperature this variation is governed by the thermal voltage $V_T$. Thus $I_x$ established by $V_{be}$ and the resistance of $R_{REF}$, is stable.

The current mirror responds to current $I_x$ and establishes the reference current $I_{REF}$ from the drain of transistor $Q_5$. $I_{REF}$ is about equal to $I_x$ multiplied by a constant. In this case, the constant is a number representing the ratio of the gate areas of transistor $Q_5$ to transistor $Q_4$. In other words, letting $a_4$ represent the area of the gate of transistor $Q_4$ and letting $a_5$ represent the gate area of transistor $Q_5$, the constant is about equal to $a_5$ divided by $a_4$. Typically, $a_4$ equals $a_5$, making the constant equal to one, providing that $I_{REF}$ about equals $I_x$.

Temperature compensator 130 includes four NPN bipolar transistors ($Q_6$, $Q_7$, $Q_8$ and $Q_9$), and resistor $R_2$. Transistor $Q_6$ includes a collector and a base coupled to the source of transistor $Q_5$ of reference current generator 120. An emitter of transistor $Q_6$ is coupled to $V_{EE}$. Transistor $Q_7$ and transistor $Q_8$ each include a collector coupled to a summing node (node B), and a base coupled to the base of transistor $Q_6$. An emitter of transistor $Q_8$ is coupled to second voltage reference $V_{EE}$, with an emitter of transistor $Q_7$ coupled to a first terminal of resistor $R_2$. A second terminal of resistor $R_2$ is coupled to second voltage reference $V_{EE}$. Transistor $Q_9$ is diode-connected, with a base terminal coupled to a collector terminal. An emitter of transistor $Q_9$ is coupled to the summing node.

In operation, reference current $I_{REF}$ establishes a bias level (a base bias voltage and a base bias current) for transistor $Q_6$. Transistor $Q_7$ and transistor $Q_8$ operate as special current mirrors to each produce a current ($I_7$ and $I_8$, respectively). These are special current mirrors because they are balanced and designed to provide temperature compensation for current $I_{TEMP}$. Current $I_7$ and current $I_8$ will each be about equal to a constant multiplied by $I_{REF}$, similar to the current mirror described above.

However, these constants will be a function of the temperature compensation. As well known, bipolar transistors experience an inverse relationship between current and temperature, referred to as having negative temperature coefficient. Current $I_8$ will experience a total inverse relationship to temperature as the value of the current is established solely by transistor $Q_8$. Current $I_7$ on the other hand, is dependent upon the voltage difference ($V_{be}Q_6$–$V_{be}Q_7$) and resistor $R_2$. By designing the combination of ($V_{be}Q_6$–$V_{be}Q_7$) and resistor $R_2$ appropriately allows for positive temperature coefficient for current $I_7$.

The summing node adds current $I_7$ and current $I_8$ to produce a temperature compensated current $I_{TEMP}$. Designing the relative values of the mirroring constants of transistor $Q_7$ and transistor $Q_8$, $I_{TEMP}$ can be made to be relatively invariant with respect to temperature, or to have a net change (either direct or inverse) depending upon the desired implementation.

Transistor $Q_9$ reduces the voltage seen across transistors $Q_8$ and $Q_7$. This minimizes breakdown conditions for these transistors. Breakdown of the collector to emitter junction is process dependent. Transistor $Q_9$ is optional and used for specific embodiments. In some embodiments, transistor $Q_9$ may be sized differently or eliminated.

Current mirror 140 includes two PMOS transistors ($Q_{10}$ and $Q_{11}$). Transistor $Q_{10}$ includes a source coupled to first voltage reference $V_{cc}$, and a gate and a drain both coupled to the collector of transistor $Q_9$. Transistor $Q_{11}$ includes a source coupled to first voltage reference $V_{cc}$ and a gate coupled to the gate of transistor $Q_{10}$.

Current mirror 140 is responsive to the current $I_{TEMP}$ produced from temperature compensator 130 to produce a mirror current $I_{MIRROR}$. Current $I_{TEMP}$ generates a gate voltage ($V_{PCS}$) at transistor $Q_{10}$. The gate voltage $V_{PCS}$ at transistor $Q_{11}$ causes transistor $Q_{11}$ to produce current $I_{MIRROR}$ at the drain terminal. As described above, current $I_{MIRROR}$ is related to current $I_{TEMP}$ by a ratio of the gate areas of transistor $Q_{11}$ to transistor $Q_{10}$. In the preferred embodiment, the areas are made about equal, providing that current $I_{MIRROR}$ about equals current $I_{TEMP}$ , Bias voltage generator 150 includes an NMOS transistor $Q_{12}$. Transistor $Q_{12}$ includes a gate and a drain coupled to the drain of transistor $Q_{11}$, and a source coupled to second voltage reference $V_{EE}$. Current $I_{MIRROR}$ causes transistor $Q_{12}$ to generate the gate bias voltage $V_{NCS}$ at the drain of transistor $Q_{12}$. The gate bias voltage $V_{NCS}$ is distributed to the gates of the NMOS current sources 100 coupled to differential amplifiers 105.

Figure 5:
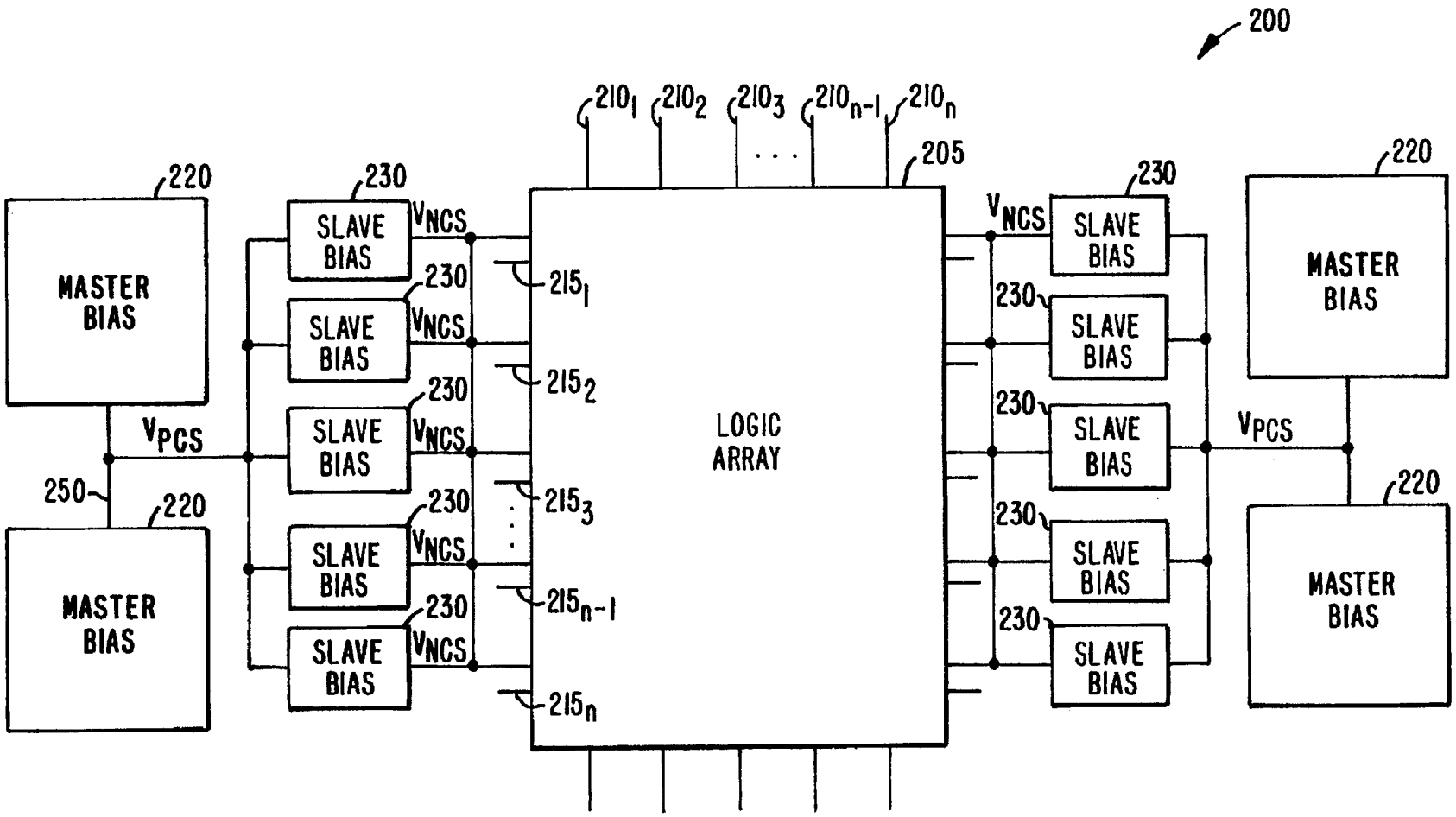
FIG. 5 is a block diagram illustrating a preferred bias distribution system according to the present invention.

FIG. 5 is a block diagram illustrating a preferred bias distribution system 200 according to the present invention. Bias distribution system 200 provides the gate bias voltage $V_{NCS}$ to all of the NMOS current sources of the thousands of differential amplifiers (not shown) in a logic array 205. Logic array 205 is an m×n array of logic blocks (not shown) that comprise the programmable logic device. In the preferred embodiment, n and m equal sixteen, making a total of 256 logic blocks. There are m columns (210$_i$, i equals 1 to m), and n rows (215$_j$, j equals 1 to n). To further compensate for temperature variations beyond those features described above, bias distribution system 200 implements bias circuit 110 as a first plurality of master bias circuits 220 and as a second plurality of slave bias circuits 230. In the preferred embodiment, there are four master bias circuits 220, two positioned along a left side of logic array 205, and two positioned along a right side of logic array 205. There is one slave bias circuit 230 for each side of each row of logic array 205, for a total of thirty-two slave bias circuits 230.

Each slave bias circuit 230 includes an equivalent to transistor $Q_{11}$ and transistor $Q_{12}$ shown in FIG. 4. Each master bias circuit 220 includes an equivalent to each of the transistors Q1-10, and resistors $R_1$, $R_2$, and $R_{REF}$. Master bias circuit 220 distributes the PMOS gate bias voltage $V_{PCS}$ to selected slave bias circuits 230, which in turn distribute the gate bias voltage to the NMOS current sources 100 shown in FIG. 3. The two master bias circuits 220 on each side provides $V_{PCS}$ to the slave bias circuits 230 on the same side. Signal lines 250 carry the $V_{PCS}$ voltage from each master bias circuit 220, with lines 250 from master bias circuits 220 on the same side of logic array 205 being connected to each other. For distribution of the gate bias voltage $V_{NCS}$, the outputs of all slave bias circuits 230 are interconnected, providing an interconnection net to the NMOS current sources 100 shown in FIG. 3.

In conclusion, the present invention provides a simple, efficient solution to a problem of bias signal distribution in programmable logic devices. While the above is a complete description of the preferred embodiments of the invention, various alternatives, modifications, and equivalents may be used. Therefore, the above description should not be taken as limiting the scope of the invention which is defined by the appended claims.

What is claimed is:

1. A circuit for biasing a plurality of differential amplifiers distributed across a semiconductor device having a programmable logic array, wherein each of the differential amplifiers includes an NMOS transistor current source that has a gate terminal for receiving a bias voltage that controls a bias current in the differential amplifier and wherein each of the differential amplifiers includes a load resistor having a resistance that varies due to a semiconductor processing variation effect that occurs during fabrication such that a gain of each of the plurality of differential amplifiers is subject to a variation from an expected value, comprising:

a bias voltage generator, coupled to each of the plurality of NMOS transistor current sources, for generating the bias voltage in response to a regulated current;

a current generator for generating a reference current, said current generator including a resistor subject to the semiconductor processing variation effect to adjust said reference current to compensate for the variation in the gain;

a temperature compensator, coupled to said current generator, for producing said regulated current from said reference current, said temperature compensator further including a first and a second bipolar transistor, each said bipolar transistor including a base, a collector and an emitter, with said collectors of said bipolar transistors coupled to a summing node, and said emitter of said first bipolar transistor coupled to a reference voltage;

a resistor, having a first terminal coupled to said emitter of said second bipolar transistor and a second terminal coupled to said reference voltage, and a third bipolar transistor, having a base coupled to a collector thereof and an emitter coupled to said reference voltage, said collector of said third bipolar transistor coupled to said current generator for establishing a base voltage and base current;

wherein said bases of said first and second bipolar transistors are each coupled to said base of said third bipolar transistor, and said first bipolar transistor and said second bipolar transistor are responsive to said base current and said base voltage to generate, respectively, a first current through said first bipolar transistor and a second current through said second bipolar transistor and said resistor such that said regulated current is produced at said summing node as a sum of said first current and said second current with said first current having an inverse relationship to a temperature variation of the semiconductor device and said second current having a direct relationship to said temperature variation; and a current mirror, coupled to said temperature compensator and to said bias voltage generator, for mirroring said regulated current produced in said temperature compensator to said bias voltage generator.

2. The biasing circuit of claim 1 wherein said first current and said second current are balanced such that a magnitude of a temperature-induced variation of said first current about equals a magnitude of a temperature-induced variation of said second current so that said regulated current has a minimal variation due to temperature.

3. The biasing circuit of claim 1 wherein said first current and said second current are balanced such that a magnitude of a temperature-induced variation of said first current is less than a magnitude of a temperature-induced variation of said second current so that said regulated current has a net variation that is directly related to temperature.

* * * * *